United States Patent [19]

Babitzka et al.

[11] Patent Number: 4,646,705

[45] Date of Patent: Mar. 3, 1987

[54] EXHAUST GAS RETURN CONTROL SYSTEM FOR AN INTERNAL COMBUSTION ENGINE

[75] Inventors: Rudolf Babitzka, Kirchberg; Wilhelm Hertfelder, Steinenbronn; Ernst Linder, Mühlacker; Walter Schlagmüller, Schwieberdingen, all of Fed. Rep. of Germany

[73] Assignee: Robert Bosch GmbH, Stuttgart, Fed. Rep. of Germany

[21] Appl. No.: 882,230

[22] Filed: Jul. 7, 1986

[30] Foreign Application Priority Data

Aug. 29, 1985 [DE] Fed. Rep. of Germany ..... 3530802
Mar. 21, 1986 [DE] Fed. Rep. of Germany ..... 3609611

[51] Int. Cl.[4] ..... F02M 25/06
[52] U.S. Cl. ..... 123/571
[58] Field of Search ..... 60/278; 123/568, 569, 123/571, 570

[56] References Cited

U.S. PATENT DOCUMENTS 4,064,851 12/1977 Wessel ..... 123/571
4,313,415 2/1982 Shinzawa ..... 123/571
4,473,056 9/1984 Ishida ..... 123/571

*Primary Examiner*—Douglas Hart
*Attorney, Agent, or Firm*—Felfe & Lynch

[57] ABSTRACT

An exhaust gas return control system for internal combustion engines is proposed, which includes an apparatus case 19 in which a servo motor 45 is disposed, which through a driving gear 47 and a driven gear 36 drives a threaded spindle 35 on which an exhaust gas valve closing member 41 is disposed which cooperates with an exhaust gas valve seat 27 on a tubular exhaust gas valve seat body 24. The apparatus case has on the side of the servo motor an air inlet of an air duct 13, 15 leading to the air induction pipe 2 of the internal combustion engine and, on the exhaust gas valve side, an exit from this air duct through which the proportionally fed exhaust gas is also led. A guiding collar 44 diverts the entry of the exhaust gas to an exhaust pipe 30 provided for the purpose. Also, in one embodiment an air valve seat body 21 radially surrounding the exhaust gas valve seat body 24 is provided, which cooperates with an air valve closing member which can be actuated simultaneously with the exhaust gas valve closing member and through which bypass air branched off upstream from a throttle valve 3 in the air induction pipe 2 can be proportionally fed.

12 Claims, 1 Drawing Figure

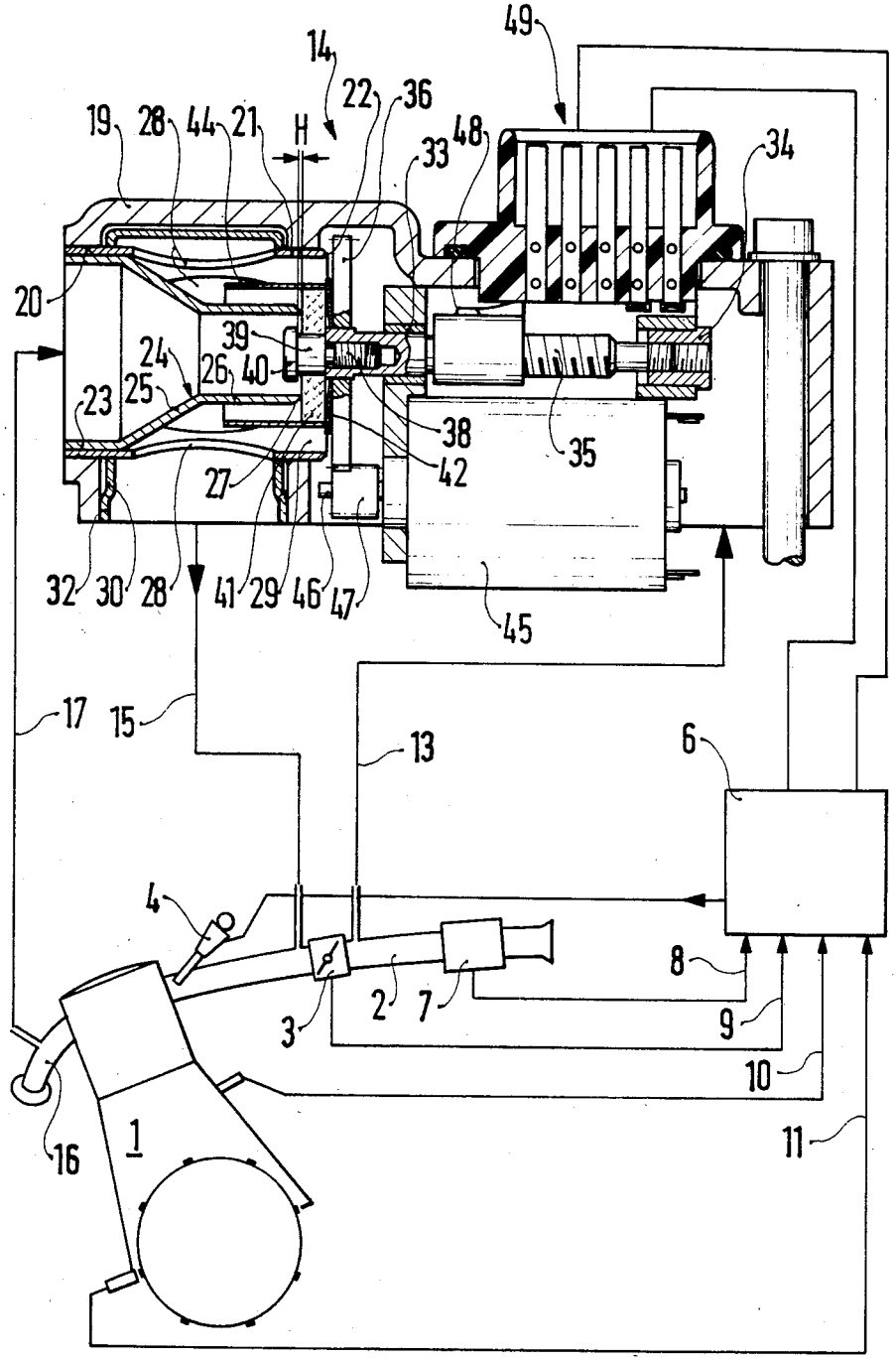
49
14
22
36
19
28
44
21
H
33
48
34
20
39
24
26
40
23
25
38
42
35
27
32
30
28
41
29
46
47
45
17
15
13
6
4
8
2
7
3
9
10
16
1
11

EXHAUST GAS RETURN CONTROL SYSTEM FOR AN INTERNAL COMBUSTION ENGINE

This invention relates to an exhaust gas return control system. An exhaust gas return control system is known, in which the exhaust gas return valve is subjected to the high temperatures of the exhaust gas, but by the use of a Bowden pull cable, the actuator of the exhaust gas return valve is situated far away from the exhaust gas return valve at a point which is exposed only to low heat stress. Also known is an exhaust gas control which has a bypass duct to the throttle valve which has a multi-path valve by which the connection of the bypass duct upstream from the throttle valve can be closed and an exhaust gas return duct can be connected to the bypass duct in the direction downstream from the throttle valve. Downstream from the multi-path valve there is disposed in the bypass duct a metering valve by which either idling air or exhaust gas is metered to the internal combustion according to operating parameters. The disadvantage, however, is that this system requires two separate servo motors which require a large amount of space. Also, there is the danger that if the exhaust gas temperatures are very high the operation of the electromagnetic servo motors is impaired or, if the exhaust gas temperature is reduced, condensation and undesirable deposits of dirt occur at the valve and metering cross sections.

SUMMARY OF THE INVENTION

The exhaust gas return control system according to the invention has the advantage that, especially when used in internal combustion engines operated by self-ignition, which freely aspirate air for the combustion, this air is used for cooling the actuating system and, since the actuating system is situated upstream from the exhaust gas return valve, its operation is not impaired by carbon deposits or other contamination. A compact construction can be achieved, and the actuating system is housed for protection against other mechanical influences. It is furthermore simple in construction and occupies little space. Also, to reduce the deposit of dirt and the formation of condensate, high returned exhaust gas temperatures can be used, since directly downstream from the exhaust gas valve seat, cooling and diluting air is always fed to the exhaust gas metered to the exhaust gas valve seat by the air induction pipe upstream of the throttle valve. In this manner the exhaust gas is not only cooled but also diluted, so that a temperature reduction and a lowering of the dew point is achieved, which reduces the formation of condensate and the danger of contamination.

By a further development the additional advantage is offered, in the use of internal combustion engines which operate with vacuum throttle control, that it is possible to control the feed of idling air together with the rate of return of the exhaust gas.

Advantageous further developments of the exhaust gas return control system are made possible. It is advantageous to dispose the exhaust gas valve closing member on a threaded spindle mounted in the case of the apparatus and rotated through a gear drive by an electromagnetic servo motor. It is furthermore advantageous for the exhaust gas valve closing member to be joined eccentrically to the threaded spindle and to be made of ceramic. It is likewise advantageous to make the driven gear of the gear drive, which is disposed on the threaded spindle, in the form of an air valve closing member and to mount the exhaust gas valve closing member for displacement on the threaded spindle against the force of a spring toward the air valve closing member. An additional advantage is offered by the arrangement of a guiding collar which extends from the exhaust gas valve closing member and encompasses part of the exhaust gas valve seat body at a radial distance therefrom. It is especially advantageous to use the air carried from the aspirating tube upstream from the throttle valve to the air valve seat for the cooling of the apparatus by passing it around the servo motor. It is also advantageous to move the exhaust gas valve closing member and the air valve closing member away from the valve seats after the internal combustion engine has been turned off, so as to prevent any freeze-up of the valve closing members at low temperatures.

In accordance with the invention, an exhaust gas return control system for an internal combustion engine having an air induction pipe and an exhaust pipe, comprises an exhaust gas return duct leading from the exhaust pipe and an exhaust valve communicating with the exhaust gas return duct. The system also includes a servo system for controlling the amount of exhaust gas flowing through the exhaust gas return duct through the exhaust gas valve in accordance with operating parameters of the internal combustion engine. The servo system has an actuating member, a transmission and an electric motor. The exhaust gas return control system also includes an air duct leading from and to the air induction pipe. The exhaust gas return duct discharges into the air duct. The exhaust gas return control system also includes an exhaust gas valve closing member and a tubular exhaust gas valve seat body in the air duct leaving free an air flow cross section to the wall of the air duct, which is more or less openable or closable by the exhaust gas valve closing member which is actuatable by the actuating member of the servo system driven by the electric motor through the transmission. The electric motor is exposed for exposure to air flowing within the air duct upstream from the exhaust gas valve.

Also in accordance with the invention, an exhaust gas return control system for an internal combustion engine having an air induction pipe and an exhaust pipe, comprises an exhaust gas return duct leading from the exhaust pipe and an exhaust gas valve communicating with the exhaust gas return duct. The system also includes a servo system for controlling the amount of exhaust gas flowing through the exhaust gas return duct through the exhaust gas valve in accordance with operating parameters of the internal combustion engine. The servo system has an actuating member. The exhaust gas return control system also includes an air duct leading from and to the air induction pipe. The exhaust gas return duct discharges into the air duct. The exhaust gas return control system also includes an exhaust gas valve closing member and a tubular exhaust gas valve seat body in the air duct, leaving free an air flow cross section to the wall of the air duct, which is more or less openable or closable by the exhaust gas valve closing member which is actuatable by the actuating member of the servo system. The tubular exhaust gas valve seat body has an exhaust gas valve seat and is disposed in the air duct, the air duct being a bypass air duct. The exhaust gas return control system also includes a throttle valve disposed in the air induction pipe, the bypass air duct branching off upstream from the throttle valve and returning back into the air induction pipe downstream from the throttle valve. The exhaust gas return control system also includes a tubular air valve seat body radially surrounding the exhaust gas valve seat body. The exhaust gas return control system also includes an air valve seat and an air valve closing member cooperative therewith. The air duct has a passage in the region of the exhaust gas valve formed by the tubular air valve seat body radially surrounding the exhaust gas valve seat body. The exhaust gas return control system also includes an air valve closing member which is actuated simultaneously with the exhaust gas valve closing member by the actuating member. In the opened state the distance from the air valve closing member to the air valve seat is greater than the distance from the exhaust gas valve closing member to the exhaust gas valve seat.

For a better understanding of the invention, together with other and further objects thereof, reference is made to the following description, taken in connection with the accompanying drawings, and its scope will be pointed out in the appended claims.

BRIEF DESCRIPTION OF THE DRAWING

Referring now to the drawing, the FIGURE is a diagrammatic view, partly in section, including an embodiment of the invention represented in simplified form for clarity, and will be further explained below.

DESCRIPTION OF A PREFERRED EMBODIMENT

Referring now more particularly to the drawing, a mixture-compressing, spark-ignition internal combustion engine is generally represented by the number 1 in the drawing. An air induction pipe 2, in which a throttle valve 3 is disposed, leads to the internal combustion engine. The fuel supplying means of the internal combustion engine 1 can be a carburetor, for example, or, as shown, fuel injection valves 4. The fuel injection valves 4 are controlled by an electronic controller 6 to which operating parameters of the internal combustion engine, converted to electrical magnitudes, can be delivered; for example, an air measuring device 7 determines the rate of air intake 8, the throttle valve position 9, the temperature 10 of the engine, the rotary speed 11, and other parameters. A bypass duct leads from the air induction pipe 2 upstream from the throttle valve 3 through a tube 13 to an idling air and exhaust gas return control system 14 and from there through a tube 15 to the air induction pipe 2. An exhaust gas return duct 17 runs from the exhaust gas pipe 16 of the internal combustion engine 1 to the idling air and exhaust gas return control system 14. The idling air and exhaust gas return control system 14 has a case 19 having an intake orifice 20 into which a tubular air valve seat body 21 is pressed. Inside of the case 19, the air valve seat body 21 is pressed. Inside the case 19, the air valve seat body 21 terminates in an air valve seat 22 which is knife-edged, for example. A tubular exhaust valve seat body 24 is pressed into the air valve seat body 21 at its holding section 23; it is of a stepped configuration and has a conical section 25 tapering from the holding section 23 into the interior of the case 19, and is adjoined by a seat section 26 which terminates in an exhaust gas valve seat 27, which can be knife-edged. The exhaust gas valve seat body 24 terminates within the air valve seat body 21, so that the exhaust gas valve seat 27 has an axial spacing from the air valve seat 22. The exhaust gas return duct 17 leads into the exhaust gas seat body 24 at the end opposite the exhaust gas valve seat 27. From the annular gap 29 formed between the exhaust valve seat body 24 and the air valve seat body 21, radial openings 28 in the air valve seat body 21 lead to the periphery of the air valve seat body 21, which in this area is transversely encompassed by an exhaust pipe 30 from which the bypass duct section 15 leads into the air induction pipe 2 downstream from the throttle valve 3. Exhaust gas and/or air thus flows from the annular gap 29 through the openings 28 into the interior of the exhaust tube 30 and from there into the bypass duct section 15. The exhaust pipe 30 is in direct contact with the apparatus case 19 at only a short, fitted section 32, so that otherwise an air gap exists between the exhaust tube 30 heated by the exhaust gas and the apparatus case 19 and this gap reduces thermal transfer to the apparatus case 19.

Within the case 19, a threaded spindle 35 is journaled in a bearing bush 33 at one end and in a threaded bush 34 at the other, and is concentric with the air valve seat body 21 and the exhaust gas valve seat body 24. A gear 36 confronting the air valve seat 22 and having a greater diameter than the latter is affixed to the threaded spindle 35. A journal screw 38 is threaded eccentrically into the end of the spindle 35 facing the valve seats 22 and 27, and presents a journal 39 extending from the end of spindle 35 and terminating in a head 40 of greater diameter than the journal 39. An exhaust gas valve closing member 41 in the form of a disk is slidingly mounted on the journal 39 of the journal screw 38, and its thickness is smaller by the amount H than the axial length of the journal 39. Between the driven gear 36 and the exhaust valve closing member 41, a plate spring 42 is disposed on the threaded spindle 35 and tends to press the exhaust valve closing member 41 against the head 40. The plate spring 42 can consist of a plurality of individual springs forming a pack. The exhaust gas valve closing member 41 has a larger diameter than the exhaust gas valve seat 27 and is aligned with the latter. Depending on the axial distance between the exhaust gas valve seat 27 and the exhaust gas valve closing member 41, a more or less great amount of exhaust gas is metered and flows from the exhaust gas return duct 17 through the exhaust gas valve seat body 24 and through the exhaust gas valve seat 27 into the annular gap 29. A pot-like guiding collar 44 encompasses the exhaust gas valve closing member 41 on its side facing the driven gear 36 and is pressed by the plate spring 42 against the exhaust gas valve closing member 41. The guiding collar 44 has a greater inside diameter than the outer circumference of the seat section 26 of the exhaust gas valve seat body 24, and extends at a radial distance from the latter into the annular gap 29 at least as far as the beginning of the openings 28. In this manner the exhaust gas flowing over the exhaust gas valve seat 27 is turned about and carried to the vicinity of the openings 28, without any danger that exhaust gas will pass over the air valve seat 22 into the interior of the apparatus case 19. The driven gear 36 serves simultaneously as an air valve closing member and cooperates with the air valve seat 22. An electromagnetic servo motor 45 is disposed in the apparatus case 19 and is offset parallel to the threaded spindle 35. On its shaft 46 there is fastened a driving gear 47 which meshes with the driven gear 36 and drives it. The servo motor 45 is disposed in the apparatus case 19 such that the air flowing through the bypass duct 13 to the air valve seat 22 passes through the apparatus case 19 and cools the servo motor 45.

The radial position of the threaded spindle 35 can be detected by a position sender, e.g., a potentiometer which has a wiper 48 disposed on the threaded spindle 35 and whose measurement value can be delivered through an electrical connector 49 to the electronic control unit 6. The electronic control unit likewise provides through the connector 49 for the control of the servo motor 45 on the basis of operating parameters of the internal combustion engine.

In the case of a shut-down of the internal combustion engine, it is advantageous to provide for the electronic control unit 6 to operate the servo motor 45 such that the exhaust gas valve closing member 41 and the air valve closing member 36 will be driven away from the exhaust gas valve seat 27 or air valve seat 22, as the case may be, so as to prevent freeze-up of the valve closing members 36 and 41 due to icing at temperatures below freezing.

The idling air and exhaust gas return control system 14 is controlled by the electronic control unit 6 such that, while the internal combustion engine is warming up and when the internal combustion engine is hot, the idling speed is established by a more or less great lifting away of the air valve closing member 36 from the air valve seat 22, while the exhaust gas valve closing member 41 engages the exhaust gas valve seat and blocks the latter. When the exhaust gas valve closing member 41 is engaged with the exhaust gas valve seat, when the threaded spindle 35 rotates, due to the eccentric position of the journal screw 38, the face of the ceramic exhaust gas valve closing member 41 rubs on the exhaust gas valve seat 27, so that any dirt particles that may have been deposited will be removed. When the internal combustion engine 1 is operated on a load range in which the NOx content in the exhaust gas is reducible by recycled exhaust gas, the servo motor 45 shifts the threaded spindle 35 through the gears 36 and 47 such that the exhaust gas closing member 41 lifts away from the exhaust gas valve seat and thereby causes a certain amount of exhaust gas to flow from the exhaust gas return duct 17 into the bypass duct 15. Simultaneously, however, an amount of air continues to be metered between the air valve seat 22 and the air valve closing member 36 from the bypass tube 13 and to be fed to the exhaust gas downstream from the exhaust gas valve seat 27, so that the exhaust gas is diluted and cooled. As a result of the axial movability of the exhaust gas closing member 41 on the journal 39 of the journal screw 38 by the amount H, the exhaust valve closing member 41 closes the exhaust valve seat 27 at the end of the exhaust gas return and is urged by the plate spring 42 against the exhaust gas valve seat 27, but the air valve closing member 36 then is still at a sufficiently great distance from the air valve seat 22 for the metering of air for idle speed control.

In the application of the above-described apparatus, on a diesel engine for example, in which the intake air is freely aspirated and there is no idling air control, the air valve seat 22 is omitted, so that a constant circulation cross section is achieved between bypass air duct 13 and 15 and the tubular exhaust gas valve seat body, and the constant flow of air around the servo system is assured.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. An exhaust gas return control system for an internal combustion engine having an air induction pipe and an exhaust pipe, comprising:

an exhaust gas return duct leading from the exhaust pipe;

an exhaust gas valve communicating with said exhaust gas return duct;

a servo system for controlling the amount of exhaust gas flowing through said exhaust gas return duct through said exhaust gas valve in accordance with operating parameters of the internal combustion engine, said servo system having an actuating member, a transmission and an electric motor;

an air duct leading from and to the air induction pipe;

said exhaust gas return duct discharging into said air duct;

an exhaust gas valve closing member;

a tubular exhaust gas valve seat body in said air duct, enclosing inside an exhaust gas flow cross section and leaving free outside an air flow cross section to the wall of said air duct, which exhaust gas flow cross section is more or less openable or closable by said exhaust gas valve closing member which is actuatable by said actuating member of said servo system driven by said electric motor through said transmission, said electric motor being disposed for exposure to air flowing within said air duct upstream from said exhaust gas valve.

2. An exhaust gas return control system for an internal combustion engine having an air induction pipe and an exhaust pipe, comprising:

an exhaust gas return duct leading from the exhaust pipe;

an exhaust gas valve communicating with said exhaust gas return duct;

a servo system for controlling the amount of exhaust gas flowing through said exhaust gas return duct through said exhaust gas valve in accordance with operating parameters of the internal combustion engine, said servo system having an actuating member;

an air duct leading from and to the air induction pipe;

said exhaust gas return duct discharging into said air duct;

an exhaust gas valve closing member;

a tubular exhaust gas valve seat body in said air duct, enclosing inside an exhaust gas flow cross section and leaving free outside an air flow cross section to the wall of said air duct, which exhaust gas flow cross section is more or less openable or closable by said exhaust gas valve closing member which is actuatable by said actuating member of said servo system, said tubular exhaust gas valve seat body having an exhaust gas valve seat and being disposed in said air duct, said air duct being a bypass air duct;

a throttle valve disposed in the air induction pipe, said bypass air duct branching off upstream from said throttle valve and returning back into the air induction pipe downstream from said throttle valve;

a tubular air valve seat body radially surrounding said exhaust gas valve seat body;

an air valve seat and an air valve closing member cooperative therewith;

said air duct having a passage in the region of said exhaust gas valve formed by said tubular air valve seat body radially surrounding said exhaust gas valve seat body; and an air valve closing member which is actuated simultaneously with said exhaust gas valve closing member by said actuating member, and in the opened state the distance from said air valve closing member to said air valve seat being greater than the distance from said exhaust gas valve closing member to said exhaust gas valve seat.

3. An exhaust gas return control system according to claim 2, in which said servo system has a transmission and an electric motor which through said transmission drives said actuating member and in which said electric motor is disposed awash with air within said air duct upstream from said exhaust gas valve.

4. An exhaust gas return control system according to claim 3, which includes an apparatus case having a threaded spindle journaled therein and serving as said actuating member, on which said exhaust gas valve closing member is disposed, said transmission including a driven gear disposed on said actuating member, and said transmission including a driving gear, and which includes an electromagnetic servo motor having a driving shaft on which said driving gear is fastened, said driving gear engaging said driven gear.

5. An exhaust gas return control system according to claim 4, in which said exhaust gas valve closing member is joined eccentrically to said threaded spindle.

6. An exhaust gas return control system according to claim 5, in which said exhaust gas valve closing member is made of ceramic.

7. An exhaust gas return control system according to claim 4, in which said driven gear is an air valve closing member.

8. An exhaust gas return control system according to claim 7, which includes a spring and in which said exhaust gas valve closing member is mounted on said threaded spindle for displacement against the force of said spring in the direction of said air valve closing member.

9. An exhaust gas return control system according to claim 8, in which, after the shut-down of the internal combustion engine, said exhaust gas valve closing member and said air valve closing member are movable away from their respective valve seats.

10. An exhaust gas return control system according to claim 2, which includes a guiding collar projecting from said exhaust gas valve closing member and partially encompassing said exhaust gas valve seat body at a radial distance away therefrom.

11. An exhaust gas return control system according to claim 4, in which said air valve seat body is inserted into said apparatus case and air carried through said bypass duct from the air induction pipe upstream from said throttle valve to said air valve seat flows around said electric motor.

12. An exhaust gas return control system according to claim 11, in which said air valve seat body has radially disposed openings through which air and exhaust gas flow into an exhaust pipe transversely encompassing said air valve seat body in the area of the openings, and which is in contact with said apparatus case only over a short guiding section.

* * * * *